United States Patent [19]

Rudy

[11] Patent Number: 4,964,827

[45] Date of Patent: Oct. 23, 1990

[54] FLOATATION DEVICE FOR SWIMMERS

[76] Inventor: Issac Rudy, 711 Avenue R, Brooklyn, N.Y. 11223

[21] Appl. No.: 370,641

[22] Filed: Jun. 23, 1989

Related U.S. Application Data

[63] Continuation-in-part of Ser. No. 353,465, May 18, 1989, Pat. No. 4,936,806.

[51] Int. Cl.[5] ..... A63B 31/12

[52] U.S. Cl. ..... 441/59; 441/80

[58] Field of Search ..... 441/55, 59, 60, 64, 441/80, 102, 103, 106, 107, 111, 112–118, 122, 129, 131

[56] References Cited

U.S. PATENT DOCUMENTS

| | | | |
|---|---|---|---|
| 1,245,033 | 10/1917 | Ross | 441/107 |
| 3,097,375 | 7/1963 | Griffith | 441/59 |
| 3,107,371 | 10/1963 | Thompson | 441/59 |
| 4,737,127 | 4/1988 | Lamont | 441/64 |

FOREIGN PATENT DOCUMENTS

| | | | |
|---|---|---|---|
| 3539528 | 3/1987 | Fed. Rep. of Germany | 441/59 |
| 620973 | 5/1961 | Italy | 441/59 |

*Primary Examiner*—Joseph F. Peters, Jr.
*Assistant Examiner*—Edwin L. Swinehart
*Attorney, Agent, or Firm*—Abelman Frayne Rezac & Schwab

[57] ABSTRACT

A flotation device for use by swimmers and which is to be positioned over a user's upper arm in encircling relation therewith, includes at least one extension that extends in a direction transverse to the longitudinal axis of the flotation device, and which can be grasped by a supervisor in the event of an emergency.

2 Claims, 2 Drawing Sheets

FIG. 4
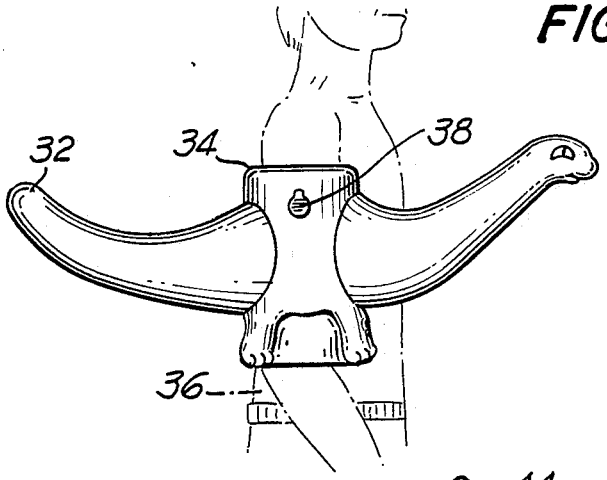
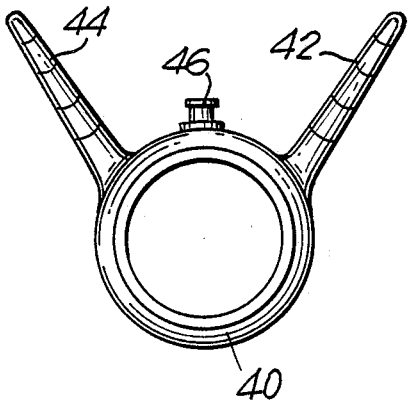
FIG. 5
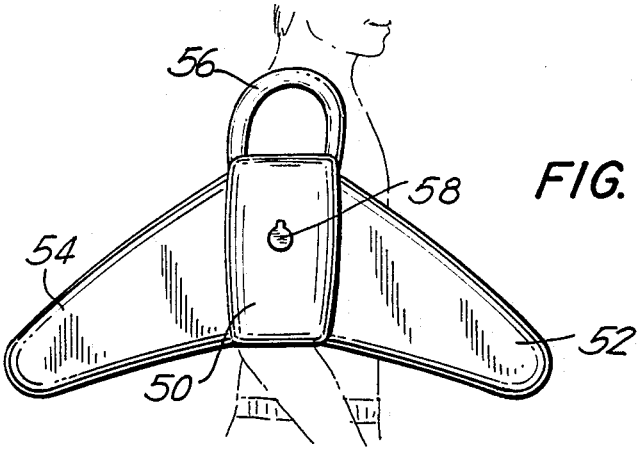
FIG. 6

FLOATATION DEVICE FOR SWIMMERS

This application is a continuation-in-part of Ser. No. 353,465 filed May 18, 1989, now U.S. Pat. No. 4,936,806.

FIELD OF THE INVENTION

This invention relates to a device to be worn in encircling relation with a user's upper arm, and which provides a floatation device for the user when emersed in water.

BACKGROUND OF THE INVENTION

Devices of this type are well known in the art, including a device as disclosed in U.S. Pat. No. Des. 205,327, issued July 19, 1986 to Lukas, which is in the form of dual inflatable annular air chambers adapted to be positioned over and encircle a user's upper arm, the air chambers being connected to each other in parallel relation and each having an inflation nipple. The advantage of such a construction is that reduced but still adequate buoyancy is provided to the user in the event of puncturing of one the air chambers, or, the accidental dislodgement of the closure plug of the inflation nipple associated with that chamber.

Such a device is somewhat difficult to grip in the event that a supervisor is required to give quick assistance to the user, who possibly is an inexperienced swimmer such as a learning child.

Such devices closely embrace the user's upper arm with a frictional grip to minimize the tendency of the device to slip longitudinally off the user's arm when in a straightened position. However if the user's arm is wet, the film of water on the user's arm provides an efficient lubricant for the material from which the device has been formed, typically polyvinylchloride sheeting. This allows for the slippage of the device longitudinally of the user's arm.

SUMMARY OF THE INVENTION

Optionally, but not preferably, the floatation device is comprised of a single inflatable annular air chamber, or is in the form of an annulus formed from a buoyant material by molding. More preferably, the floatation device is comprised of dual inflatable annular air chambers which are connected in parallel with each other, and which include an inflatation nipple permitting inflation of that chamber. If desired, multiple such annular air chambers, or corresponding members made from buoyant material by molding can be provided, the actual construction of the upper arm engaging portion of the device being of any construction that is engageable over the user's upper arm, and which has a specific gravity sufficiently lower than one to provide the required floatational support or the user.

Of essence to the present invention is that an extension be formed integrally with the arm engaging portion of the device which extends away from the user's arm, and which can be grasped by a supervisor in the event that the user is in need of assistance.

The extension can extend radially of the arm engaging portion, or, it can extend in a direction longitudinally of the axis of the arm engaging portion. Optionally, two or more extensions can extend radially of the arm engaging portion either on a diameter thereof or at an included angle relative to each other. In this event, the respective extensions can simulate a head and a tail of a creature, or wings of a butterfly or bird, or, they can simulate fins of a fish, the requirement being that they be capable of being easily grasped by a supervisor.

Alternatively, the extensions can extend in directions axially of the arm engaging portion, and again be formed to simulate a head and a tail of a creature or device, at least one of the extensions extending spaced from the user's arm in a position that is readily can be grasped by a supervisor. If this orientation of extensions is adopted, then, the other of the extensions is so configured that it extends upwardly of the user's arm and engages over the user's shoulder. This configuration of the second extension will provide stability of the device on the user's arm, and will serve to locate the arm engaging portion of the device against slippage downwardly along the user's arm and towards the user's hand, such as can occur in the event that the user is playing in water. There is a possibility that the device will rotate about the user's upper arm due to the force of water impacting against the device. Should this happen, the device is still positionally held on the user's upper arm in that the extension will still remain engaged over the user's shoulder.

The device can be of any desired shape and configuration, provided that it meets these requirements, thus making it possible to provide a device simulating, for example, an animal or fish having a head and a tail, or a humanoid or fictitious character having a head and legs, or, a representation of a mechanical device such as an automobile, aeroplane, ship etc. These examples are given as illustrations only of the various shapes and forms the device can simulate and in no way are to be considered limiting as to the many varied forms that can be applied to the floatation device.

Optionally, the floatation device instead of being comprised of at least one inflatable air chamber, can be formed as a molding of any pliant material having inherent floatation properties, such as closed cell foamed plastics materials, or fabric coverings enclosing bubbles of plastics material. In this event, the device would not be collapsible prior to and subsequent to use, but instead would retain is molded form. The formation of the device from such closed cell foamed plastics material, would, of course, enable the molding of the device to extremely complex and highly decorative shapes while retaining the ability of the device to resist slippage of the user's arm, and also that of providing a handle or tail that is easily grasped by a supervisor.

DESCRIPTION OF THE DRAWINGS

The invention will now be described with reference to the accompanying drawings, which illustrate a preferred embodiment of the invention, and, in which:

FIG. 4 illustrates another form of the floatation according to the present invention in side elevation;

FIG. 5 illustrates still another embodiment of the invention in end elevation; and, FIG. 6 illustrates still a further embodiment of the present invention in side elevation.

DESCRIPTION OF THE PREFERRED EMBODIMENTS

Figure 1:
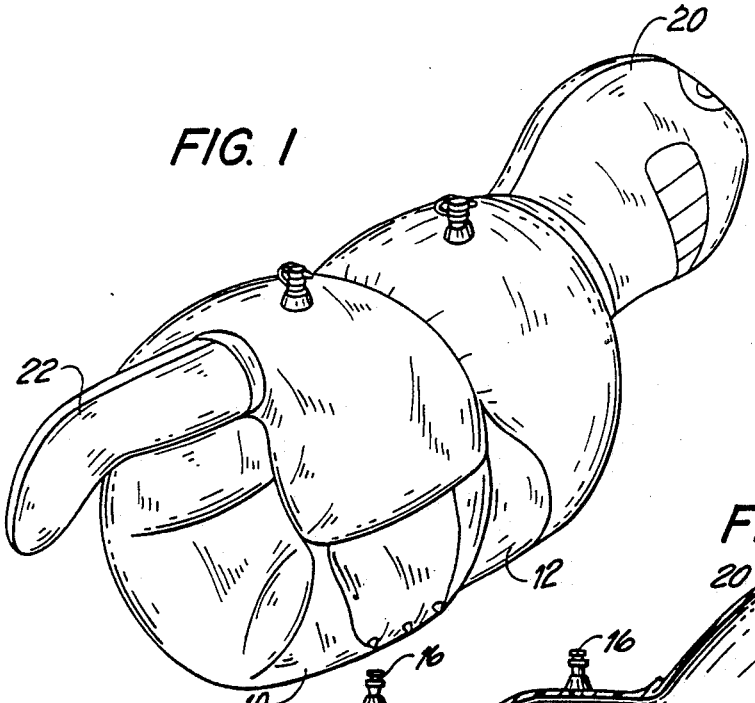
FIG. 1 is a perspective view of one form of the floatation device according to the present invention, when in an inflated condition.
Figure 2:
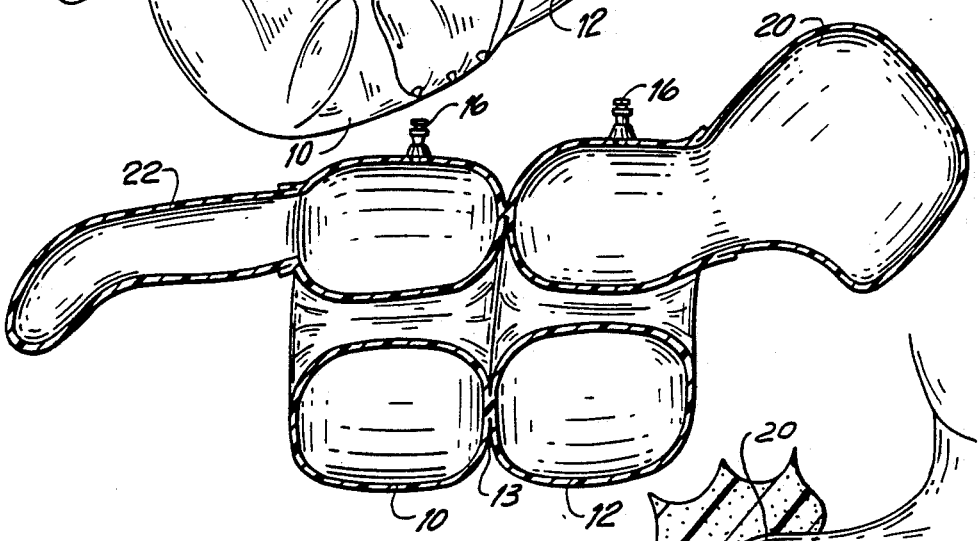
FIG. 2 is a longitudinal section through the device of FIG. 1.

Referring now to the FIGS. 1 and 2, the floatation device includes two separate air chambers 10 and 12 of annular form, and which have been formed from any suitable air-impervious material. Polyvinylchloride sheeting is typical of such suitable materials, in that it is pliant, hydrophobic, and of pleasant touch to the human skin. The air chambers 10 and 12 are joined to each other by a weld 13 in parallel relationship, and, are sized for them to be readily applied about a user's arm with the user's arm extending through the center of the respective annuli. Separate inflation nipples 14 16 are provided for the respective air chambers 10 and 12, whereby the extent of inflation of either one of the chambers can be changed to the comfort of the user. Also in the event that one of the inflation nipples should become opened during use of the device, or one of the inflated air chambers 10 or 12 be accidentally perforated, then, the device will remain at least partially operative to support the user in a body of water.

Water will provide an efficient lubricant permitting slippage of the device so far described down the user's arm, in which event, rather than to act as a floatation device for the user, the device can have the opposite result of upsetting the user in a body of water.

According to the present invention, this possibility is minimized by providing an extension 20 in communication with the annular air chamber 12 the extension 20 being of a shape such that, without regard to the position of the device circumferentially of a user's arm, the extension 20 will hook-over the user's shoulder, and be effective to minimize the possibility of the device slipping down the user's arm. The extension 20 is in direct communication with the air chamber 12, and thus, is inflated in unison with the air chamber 12.

The air chamber 10, similarly is provided with an inflatable extension 22 in direct communication with the air chamber 10, and which is inflated in unison with the air chamber 10. The extension 22 is adapted to extend downwardly of the user's arm, and, to extend freely from the air chamber 10. Thus, in the event that the user should be experiencing difficulties in swimming and needs to be retrieved from the body of water, then, a supervisor can grasp the extension 22 in the manner of a handle, and use the handle to forcibly drag the user to safety.

While the floatation device of the present invention is designed primarily for the use of inexperienced swimmers such as learning children, it can, of course, be made of any size appropriate to any persons, including adults.

As illustrated in the drawings, the respective air chambers 10 and 12 and the extensions 20 and 22 can be formed and decorated to simulate an animal, or any other device compatible with the formation of the extension 20 to hook-over the user's shoulder, and, the formation of the extension 22 to remain free of the user's arm and provide a handle that can be grabbed by a supervisor.

The device in its entirety conveniently can be formed from polyvinylchloride sheeting, such a material being readily heat or ultrarosonically or dielectrically fusible as is well known in the art. Equally well, it could be formed from natural or synthetic rubber material.

While the device illustrated includes dual inflatable air chambers 10 and 12, it will be appreciated that both of the extensions 20 and 22 could be provided on a single inflatable air chamber. Also, it will be appreciated that more than two inflatable air chambers may, if desires, be provided. Two chambers are, however, preferable, in that they will engage the user's upper arm on opposite sides of the bicep, and, the bicep itself will act as a stabilizer maintaining the device in position on the user's upper arm. However, when the user's arm is in a straightened condition, the bicep will be in a stretched condition and exhibit little effect on accidental slippage of the device downwardly on the user's arm. It is at this point that the extension 20 exhibits its intended function of restraining such downward slippage of the device on the user's arm.

Preferably, the extension 22 is arranged to extend at a position spaced from the user's arm, thus providing ready access for grabbing by a supervisor should the need arise.

The exterior configuration and decoration of the device can take any form desired. For example, for it to simulate an animal form, a humanoid form or an imagined form, or, a mechanical device such as a plane, ship or automobile, or it can simulate a fish such as a shark or stingray, or, it can take the form of a robot, or, in fact any other form that will provide an extension 20 adapted to overlie the user's shoulder, and an extension 22 providing a tail or handle that readily can be grabbed by a supervisor.

Referring now to FIG. 4, an alternative embodiment of the invention is shown. In this embodiment, the respective extensions 30 and 32 extend laterally of an air chamber 34, and lies substantially in a plane including the longitudinal axis of the air chamber 34, for them to extend forwardly and rearwardly of the user's arm, indicated in chain dotted lines at 36. While this alternative construction does not provide the benefit of engagement over the user's shoulder, it does provide non-slip advantages acting to hold the floatation device securely on the user's upper arm, in that any deflection of the lateral extensions 30 and 32 will act to increase the pressure within the air chamber 34, and, will act to secure the air chamber 34 more securely on the user's arm.

FIG. 5 illustrates another embodiment of this invention, which comprises a modification of the floatation device of FIG. 4, but, which employs the same principles in securing the floatation device on the user's upper arm.

In FIG. 5, which shows the floatation device in end view, an annular air chamber 40 is provided with two extensions 42 and 44, which are arranged in the manner of dihedrals, and which, for example, can simulate the wings of a butterfly or bird, fins of a fish etc.

As in FIG. 4, lateral deflection of the extensions 42 and 44 Will cause an increase in pressure in the annular air chamber 40, thus acting to secure the floatation device more securely on the user's upper arm.

The alternative embodiment of FIG. 6 employs both the advantages of FIGS. 1 and 2, and, the advantages of FIGS. 4 and 5. In FIG. 6 an annular air chamber 50 adapted to be received on the user's upper arm is provided with lateral extensions 52 and 54, corresponding with the lateral extensions 30, 32 of FIG. 4 and 42, 44, of FIG. 5. Additionally, the floatation device of FIG. 6 includes a strap portion 56 adapted to extend over the user's shoulder, and act further to secure the floatation device on the user's upper arm.

In each of FIGS. 4, 5 and 6, the lateral extensions 30, 32 or 42, 44, or 52, 54 are each formed integrally with the upper arm engaging portion 34, 40 or 50, and, are inflated in unison with the respective annular air chambers 34, 40, 50, the respective annular air chambers 34, 40, 50 being provided with an inflation nipple 38, 46, 58, as is well known in the art.

Figure 3:
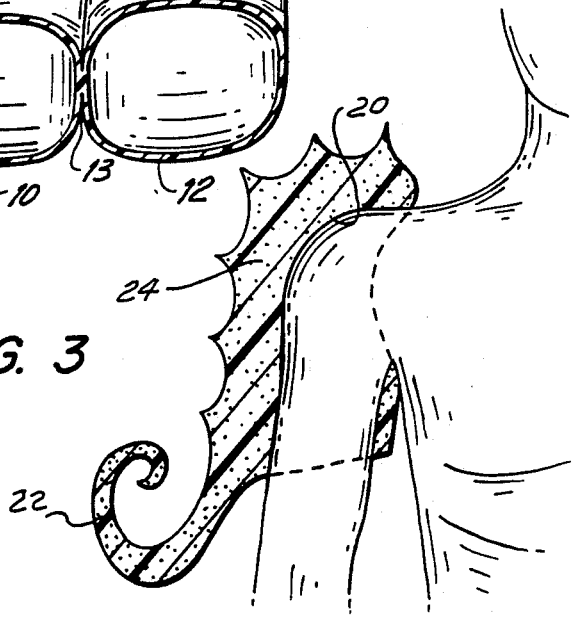
FIG. 3 is a longitudinal cross-section through another form of the device.

In the embodiments of FIGS. 4, 5 and 6, lateral extensions are provided which readily can be grasped by a supervisor in the event that assistance to the user is required, as in the embodiments of FIGS. 1, 2 and 3, this in turn increasing the holding pressure of the floatation device on the user's upper arm.

While preferable, in that the formation of the device as an inflatable device will faciliate collapsing and storage of the device when not needed in a flattened condition, the floatation device can be formed in any other desired manner having a specific gravity considerably less than water for it to provide the required floatation characteristics. For example, and as shown in FIG. 3, the device can be molded as a three-dimensional device 24 using a suitable closed cell foamed plastics material. Molding of the device will provide widely extended possibilities in the modelling of the device, with, of course, the disadvantage that the device cannot be collapsed when not in use. The device can, however, comprise a child's toy for use as a plaything when not required in its specific use as a floatation device, for example, a toy for use by a child in the bath. As in previous embodiments, the device 24 includes an extension 20 adapted to engage over the user's shoulder, and an extension 22 adapted to be grasped by a supervisor. Innumerable possibilities arise in the specific form of the device, which can be any of those previously mentioned, including, as shown, a simulation of a sea horse.

I claim:

1. A floatation device for use by swimmers, including:

an inflatable tubular body having axially spaced ends which is attachable to a user's arm in encircling relation therewith, with a longitudinal axis of the tubular body extending longitudinally of the user's arm; and, at least one lateral extension of said tubular body communicating with said body at a position intermediate said axial ends for inflation in unison therewith, said lateral extension extending radially outwardly of said body in a direction transverse to the longitudinal axis of said body.

2. The floatation device of claim 1, including two said lateral extensions in communication with said tubular body for inflation in unison therewith, the respective lateral extensions extending in opposite radial directions relative to the longitudinal axis of said body and transverse thereto.

* * * * *